US006370883B1

(12) United States Patent
Kugel

(10) Patent No.: US 6,370,883 B1
(45) Date of Patent: Apr. 16, 2002

(54) DEVICE FOR THE THERMAL CONTROL OF LIQUIDS CONTAINED IN VESSELS

(76) Inventor: Raimund Kugel, Hauptstrasse 28, D-66871 Dennweiler-Frohnbach (DE)

( * ) Notice: Subject to any disclaimer, the term of this patent is extended or adjusted under 35 U.S.C. 154(b) by 0 days.

(21) Appl. No.: 09/618,093

(22) Filed: Jul. 17, 2000

(51) Int. Cl.[7] ..... F25B 21/02; F25D 3/08

(52) U.S. Cl. ..... 62/3.64; 62/457.4

(58) Field of Search ..... 62/3.64, 457.4, 62/3.2, 3.6, 457.1, 457.3, 457.9; 222/146.6

(56) References Cited

U.S. PATENT DOCUMENTS

| | | | | |
|---|---|---|---|---|
| 5,408,845 | A | 4/1995 | Forshaw et al. | |
| 5,544,489 | A | 8/1996 | Moren | |
| 5,572,872 | A | 11/1996 | Hlavacek | |
| 6,000,224 | A * | 12/1999 | Foye | 62/3.2 |
| 6,182,863 | B1 * | 2/2001 | Van Der Meer et al. | 222/146.6 |

FOREIGN PATENT DOCUMENTS

| | | |
|---|---|---|
| DE | 252782 | 10/1912 |
| DE | 1482674 | 7/1969 |
| DE | 80856 | 3/1971 |
| DE | 34 13031 | 10/1985 |
| FR | 2 435 821 | 4/1980 |
| GB | 844652 | 8/1960 |
| GB | 2 303 692 A | 2/1997 |
| JP | 2000171142 A * | 6/2000 |

* cited by examiner

*Primary Examiner*—Denise L. Esquivel
*Assistant Examiner*—Chen Wen Jiang
(74) *Attorney, Agent, or Firm*—Foley & Lardner

(57) ABSTRACT

A device is provided for the thermal control of liquids, such as, in particular beverages, contained in vessels, comprising a housing with an insert for the vessels and a cooling element, the insert having a perforated holding plate with an orifice for the vessels, said holding plate resting on a housing projection of the device. Arranged on the holding plate are at least three wire staples which are spaced apart from one another and extend to the bottom of the device, the wire staples being assembled together on the foot side by webs, and the wire staples being surrounded by a foil sock resting loosely against these. The housing is capable of being filled with a cooling medium, and there is arranged as cooling element in a recess of the wall of the housing a Peltier element which has a heat transmission surface and a countersurface, the heat transmission surface being washed around by the medium and the countersurface being ventilated.

17 Claims, 3 Drawing Sheets

30
32
15
19
17
31
2
33
29
6
16
5
18
23
4
28
27
14
12
8
7
1
9
2
22
13
24
11
20
21
3
10
26
25

DEVICE FOR THE THERMAL CONTROL OF LIQUIDS CONTAINED IN VESSELS

BACKGROUND OF THE INVENTION

The present invention relates to a device for the thermal control of liquids, such as, in particular, beverages, contained in vessels, such as, in particular, bottles.

The invention assumes that, although it is possible for liquids to be heated very quickly, for example with the aid of microwaves, cooling requires a relatively large amount of time. Thus, for example, the cooling of beverages contained in bottles from room temperature to drinking temperature (~8° C.) lasts several hours in a refrigerator and still at least one hour in a freezer.

The prior art discloses bottle coolers which use either iced water as cooling medium (DE-C 252 782) or else thermoelectric cooling means which, with appropriate polarity, extract heat from the surroundings and, with opposite polarity, emit heat, so-called Peltier elements (GB 844 652; DE 34 13 031 Al, DD 80 856).

A disadvantage of thermoelectric bottle coolers is that the lowering of the temperature of the bottle content takes up a relatively long time, since the bottles are surrounded by air. In this case, cooling is carried out by means of a fan (DD 80 856) or by heat conduction via a metal plate on which the bottle stands (GB 844 652). In DE-C 252 782, ice has to be topped up in order to maintain the desired low temperature, in this case the bottle standing in an insert consisting of flexible material impermeable to water, but this insert is suitable only for use with specific bottle diameters.

SUMMARY OF THE INVENTION

By contrast, the set object of the present invention is to provide a device with the aid of which it is possible to cool or heat bottle contents in containers on which Peltier elements act, whilst at the same time the increased heat transmission is to continue to be ensured, essentially irrespective of the diameter of the bottles.

This object is achieved by means of a device for the thermal control of beverages contained in vessels, in particular bottles, which has the features of the main claim. Advantageous embodiments are found in the subclaims.

BRIEF DESCRIPTION OF THE DRAWINGS

The present invention is explained with reference to the accompanying figures, of which.

Figure 1:
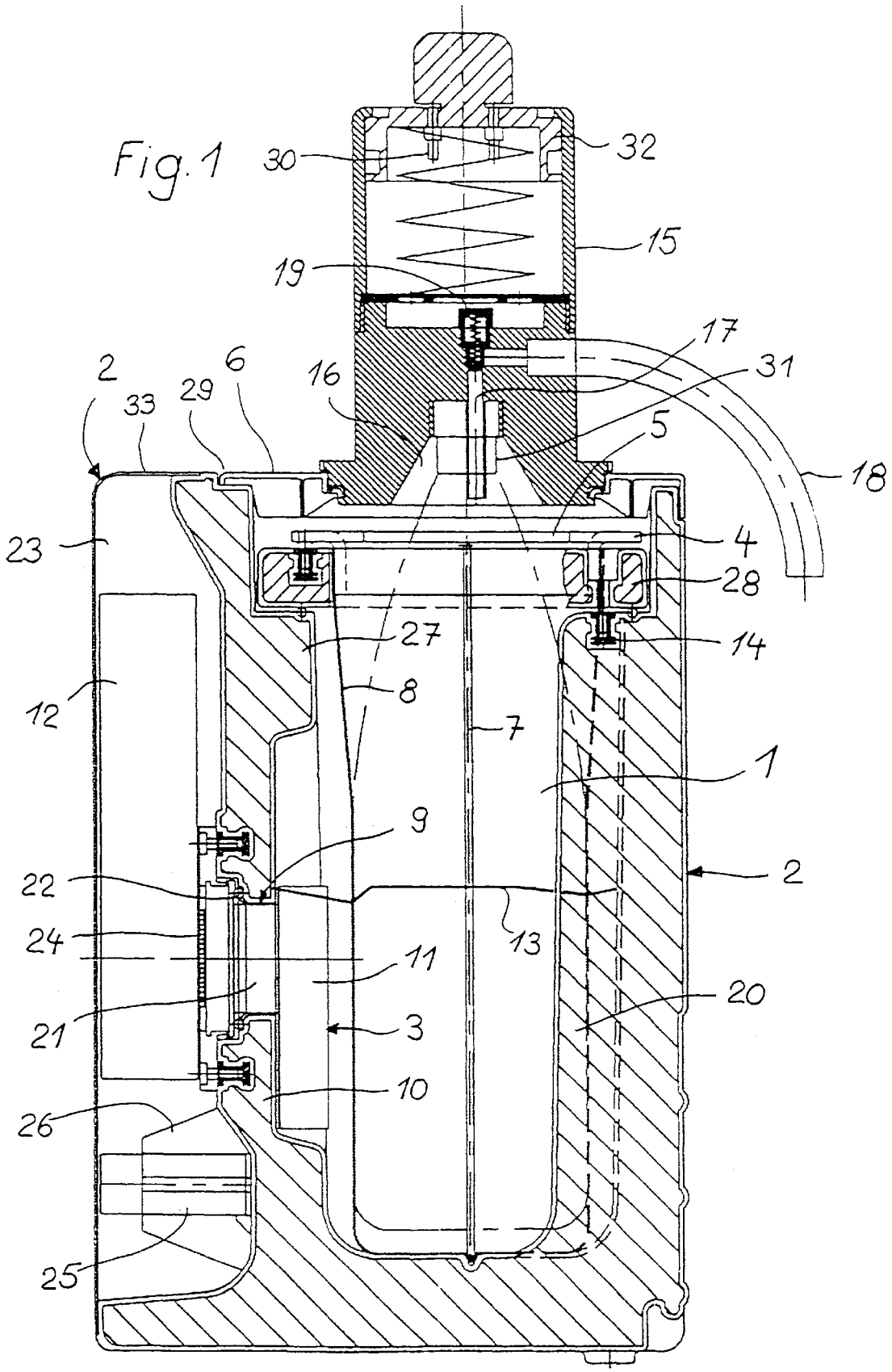
FIG. 1 shows a vertical section through the device according to the invention.

The wire staples are surrounded by a foil sock resting loosely against these and the housing is capable of being filled with a cooling medium. Arranged as cooling means in a recess in the wall of the housing is a Peltier element which has a heat transmission surface and a countersurface, the heat transmission surface being washed around by the fluid and the countersurface being ventilated. The term "fluid" refers, within the meaning of the present invention, to pourable materials, such as granulates, but preferably liquids.

DETAILED DESCRIPTION OF PREFERRED EMBODIMENTS

The embodiment according to the invention achieves an intensive thermal control of the containers over virtually the entire surface, the cooling medium used, preferably water, greatly accelerating temperature equalization between the Peltier element on account of the thermal conductivity, which is higher than that of air. However, the containers are nonetheless not wetted, and the fluid is separated completely from the containers and also from the surrounding air, so that the growth of bacteria is also ruled out, and, if appropriate, corresponding disinfectants can be added to the medium used for the transport of heat.

What is achieved by the wire staples is that the water-impermeable foil sock is spaced apart in such a way that the vessels can easily be pushed into the latter from above. Furthermore, the staples connected by means of webs fix the foil sock to the floor of the housing against lift.

The bottle of the cooling basin has a recess, in which the webs engage. This recess, advantageously designed as a V-groove, ensures that the wire staples are secured against displacement or slipping and thus remain in the virtually vertical position when the beverage containers are being put in or taken out.

The foil sock has an oversize, as compared with the vessels, so that containers dimensioned in different sizes can be thermally controlled, the hydrostatic pressure ensuring that the foil comes to rest snugly against the vessel wall over a large surface. This ensures, on the one hand, good thermal contact. On the other hand, the vessels are thereby held in the container, and lift, particularly in the case of partially emptied vessels, is counteracted.

At the same time, both the heat transmission surface and the countersurface are enlarged and have ribs, so that the efficiency of the Peltier element is increased.

It is advantageous, at the same time, that, after the polarity of the Peltier element has been reversed, the latter can also be used for heating the transmission fluid and, moreover, the vessel content, so that, for example, hot beverages can be provided as well.

In order to discharge heat from the countersurface, it is proposed that the latter be assigned a blower in a way known per se. This is arranged in the device preferably so as to run silently or be sound-insulated.

For sound insulation, the blower rests preferably in a cladding consisting of plastic foam, such as, for example, polyurethane.

Furthermore, particularly in the version consisting of plastic foam, the wall has screw inserts for the fastening of fittings, such as, in particular, the fastening ring of the holding plate for the foil sock and the Peltier element, there being arranged between the Peltier element and the wall carrying the latter a seal which separates the cooling medium space from the blower side.

It is proposed to fasten to the housing or its upper edge a pump, by means of which compressed air can be introduced into the vessel, so that the liquid contained can be discharged via a riser and an outflow, without the vessel having to be extracted. The pump may equivalently also have a compressed-gas connection or be capable of being operated electrically, and, in particular, it is hand-operated.

In order to avoid an idle stroke during pumping, there is arranged in the riser, near its upper end, an, in particular, spring-loaded nonreturn valve which, after the pumping operation has ended, prevents the emerging liquid from flowing back.

The spring of the valve may have variable spring tension, and in this way a desired excess pressure can be maintained in the gas space above the liquid in the vessel, said excess pressure reducing an undesirable escape of gas, in particular of $CO_2$.

The present invention is particularly advantageous for large-volume beverage bottles, in particular, for example, for $CO_2$-containing refreshment beverages or beer. On the one hand, because of the high efficiency of the Peltier elements and the very high heat transfer ensured according to the invention, the bottle content is cooled surprisingly quickly, approximately 15 minutes being sufficient, as a rule, for a temperature drop of up to and exceeding 10° C., and, on the other hand, the bottle content does not have to be moved during extraction, thus leading to a marked reduction in $CO_2$ losses.

The pump head preferably possesses a receptacle for the bottle neck which is equipped, for example, with a thread, into which the bottle can be screwed.

At the same time, one pump may also serve for supplying pressure to a plurality of bottles, the outlets in this case having shutoff members which are opened selectively.

The pump can be held on the housing, for example, with the aid of a bayonet fastening, and the Peltier element is regulated, in particular, by means of an adjustable thermostat.

FIG. 1 shows the housing 2 of the device, said housing having in its interior a basin 20 consisting of plastic foam which is filled with a desired quantity of cooling medium 13.

The basin 20 has, laterally, a recess 9, into which is inserted as cooling means 3 a Peltier element which is held in the basin wall via screw inserts. In this case, the ribs of the heat transmission surface 11 project into the basin interior, that is to say they are washed around by the cooling medium, preferably water, the fluid of course absorbing and transmitting heat during the reversal of polarity of the Peltier element.

Arranged in the basin wall 10 is a spacer 21 which is surrounded by an O-ring 22 and seals off the air chamber 23 against the fluid 13.

The actual Peltier surface 24 rests against the spacer 21, and the opposite side of said surface is connected to the ribs of the countersurface 12 and is acted on by the blower 25, which is inserted into holding ribs 26 consisting of plastic foam. The air chamber 23, which is closed by means of a cover plate 33, thus surrounds the blower and Peltier element and has an air supply line and an air discharge line, via which it is connected to the surrounding air.

A fastening ring 28 rests on a projection 27 on the upper part of the basin and may likewise be manufactured from plastic foam and be screwed to the basin by means of screw inserts 14. This fastening ring 28 seals off against the cooling medium 13.

The holding ring 28 surrounds the upper edge of the foil sock 8, which hangs down into the basin 20 and which is held, spaced apart, by the wire staples 7. The wire staples 7 are assembled together on the foot side by means of webs 7' and fix the foil sock 8 to the floor of the basin 20 against lift.

The basin floor has a recess 29, in which the webs 7' of the staples 7 engage are thus secured against slipping or displacement when the beverage containers 1 are put in or taken out.

The holding plate 4 and holding ring 28 are perforated, orifice 5, for putting in a bottle, the holding ring advantageously being integrated into the holding plate.

A vessel 1 (bottle) is put into the foil sock 8, the pressure of the cooling medium 13 causing the foil sock to cling snugly against the vessel wall and thus to allow heat transmission by heat conduction. The lift of the beverage container is thereby also counteracted at the same time.

The fluid 13 is thus separated from the vessel, and it can remain in the basin for a long time and, in principle, need not be exchanged. It may contain chemical additives in order to increase heat conduction.

The device can be closed by means of a removable lid 6.

So that beverages can be extracted in a metered way, for example, from particularly spacious bottles, however, a pump 15, which possesses a receptacle 16 for the neck 31 of the bottle 1, is connected to the upper edge of the housing 2 with the aid of a bayonet fastening via the lid 6, which is perforated here.

The pump 15 has a piston 32 and also valves 30, via which compressed air passes into the bottle 1 and conducts the beverage out of the interior of the bottle 1 via a riser 17, which reaches as far as the bottle bottom, to the outflow 18 by way of the nonreturn valve 19. The nonreturn valve 19 possesses a spring, the tension of which may be variable.

Figure 2:
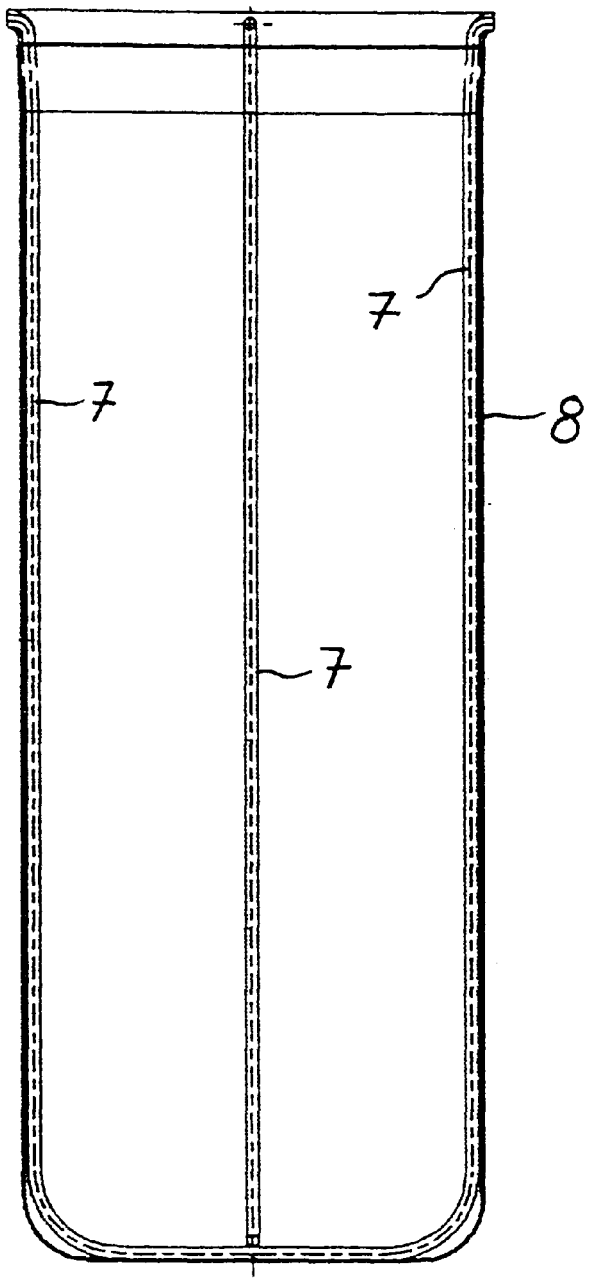
FIG. 2 shows the means for holding the foil sock.

FIG. 2 shows the foil sock 8 drawn over the essentially vertical wire staples 7. Said foil sock has an oversize in relation to the (radial) spacing of the wire staples 7, so that vessels of different diameters can also be put in. The wire staples 7, which are assembled together on the foot side by means of webs 7', hold the foil sock apart and fix the latter to the floor against lift, so that the vessels can easily be pushed in. The cooling medium stands against the outside of the foil sock, presses the foil inward and provides a large surface of contact with the vessels. At least three wire staples are necessary.

Figure 3:
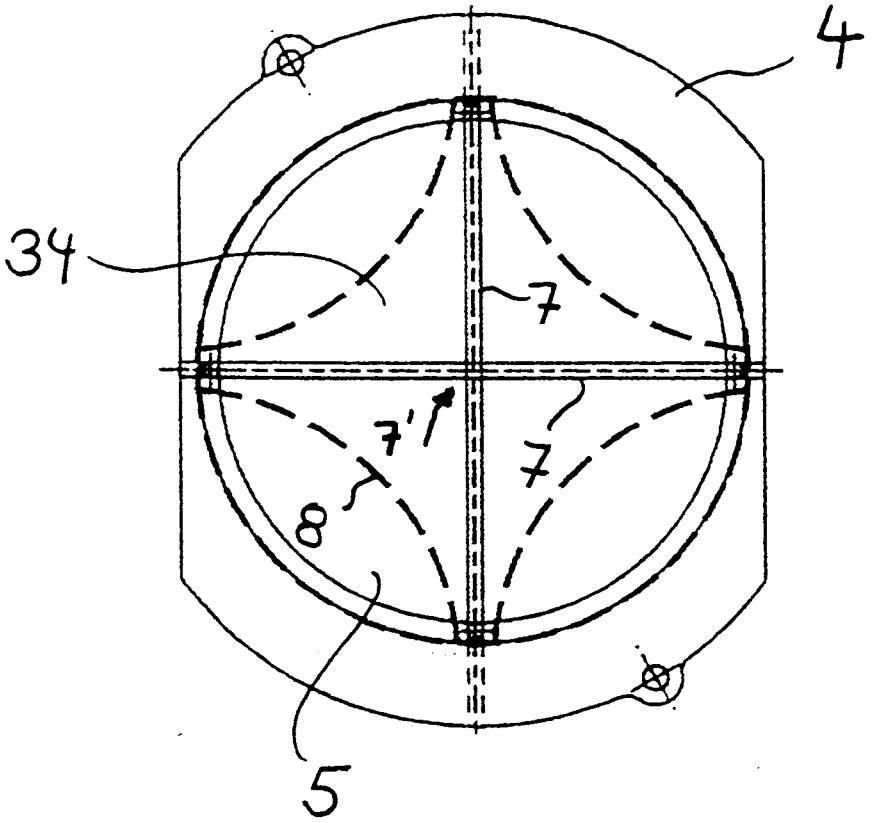
FIG. 3 shows a top view of the latter.

FIG. 3 shows the wire staples 7 which are connected to the holding plate 4 and are assembled together by means of the web 7' and which are arranged here in the form of a cross as four spacers. The foil sock 8 is bulged inward as a result of the hydrostatic pressure, and a bottle or another vessel can be pushed into the interspace 34 without difficulty. In addition, it is, of course, possible to fasten the upper edge of the foil sock to the holding plate 4 or to the fastening ring (28, FIG. 1) located below the latter, in order thereby to obtain a large push-in orifice. The holding plate 4 has the orifice 5 centrally.

List of Reference Symbols

1 Vessel
2 Housing
3 Cooling means
4 Holding plate
5 Orifice
6 Lid
7 Wire staple
7' Web
8 Foil sock
9 Recess
10 Wall
11 Heat transmission surface
12 Countersurface
13 Cooling medium
14 Screw inserts
15 Pump
16 Receptacle
17 Riser
18 Outflow
19 Nonreturn valve
20 Basin
21 Spacer
22 O-ring
23 Air chamber
24 Peltier surface

25 Blower
26 Holding ribs
27 Projection
28 Fastening ring
29 Recess
30 Valve
31 Neck
32 Piston
33 Cover plate
34 Interspace

What is claimed is:

1. An apparatus for controlling the temperature of a liquid contained in a vessel, comprising:

(a) a housing for holding a cooling medium;

(b) a housing projection;

(c) an insert in said housing for said vessel, said insert comprising:

(i) a perforated holding plate, for holding said vessel, arranged on said housing projection;

(ii) three wire frame members arranged on said holding plate such that said members are spaced apart from one another and extend to a floor of a basin of said housing;

(iii) a connector for assembling together said members on one side; and (iv) a foil sock surrounding and resting loosely against said members; and (d) a Peltier element comprising:

(i) a heat transmission surface arranged to contact said cooling medium; and (ii) a countersurface arranged to be exposed to ventilation.

2. An apparatus according to claim 1, wherein said heat transmission surface comprises ribs.

3. An apparatus according to claim 1, further comprising a blower arranged near said countersurface.

4. An apparatus according to claim 1, wherein said housing comprises a plastic foam.

5. An apparatus according to claim 1, wherein said plastic foam comprises polyurethane.

6. An apparatus according to claim 1, further comprising screw inserts in a wall of said housing for screwing said holding plate and/or said Peltier element to said housing.

7. An apparatus according to claim 1, further comprising a pump arranged on said housing and wherein said pump comprises:

(a) a receptacle for beverage bottles;

(b) an oultet line; and (c) an inlet line connected to a bottleneck.

8. An apparatus according to claim 1, further comprising a thermostat for regulating said Peltier element.

9. An apparatus according to claim 1, wherein said housing comprises, on said floor of said basin, a recess for engaging said one side of said members and said connector.

10. An apparatus for controlling the temperature of a beverage contained in a vessel, comprising:

(a) a housing for holding a cooling medium;

(b) a housing projection;

(c) an insert in said housing for said vessel, said insert comprising:

(i) a perforated holding plate, for holding said vessel, arranged on said housing projection;

(ii) three wire frame members arranged on said holding plate such that said members are spaced apart from one another and extend to a floor of a basin of said housing;

(iii) connectors for assembling together said members on one side; and (iv) a foil sock surrounding and resting loosely against said members;

(d) a Peltier element comprising:

(i) a heat transmission surface arranged to contact said cooling medium; and (ii) a countersurface arranged to be exposed to ventilation (e) a thermostat for regulating said Peltier element; and (f) screw inserts arranged in said housing for holding said holding plate and/or said Peltier element.

11. An apparatus for controlling the temperature of a beverage contained in a vessel, comprising:

(a) a housing for holding a cooling medium;

(b) a housing projection;

(c) an insert in said housing for said vessel, said insert comprising:

(i) a perforated holding plate, for holding said vessel, arranged on said housing projection;

(ii) three wire frame members arranged on said holding plate such that said members are spaced apart from one another and extend to a floor of a basin of said housing;

(iii) connectors for assembling together said members on one side; and (iv) a foil sock surrounding and resting loosely against said members;

(d) a Peltier element comprising:

(i) a heat transmission surface arranged to contact said cooling medium; and (ii) a countersurface arranged to be exposed to ventilation; and (e) a pump fastened to said housing for introducing compressed gas into a vessel and thereby discharge said beverage contained therein.

12. An apparatus according to claim 11, wherein said pump comprises a pump head.

13. An apparatus according to claim 12, wherein said pump head comprises a threaded receptacle into which a bottle can be screwed.

14. An apparatus according to claim 11, wherein said pump comprises an outflow through which said beverage may be discharged.

15. An apparatus according to claim 11, wherein said pump comprises a spring-loaded non-return valve.

16. An apparatus according to claim 15, wherein said spring comprises a variable tension spring.

17. An apparatus according to claim 11, wherein said pump is fastened to said housing with a bayonet fastener.

* * * * *